US006761269B2

(12) United States Patent
Hamming

(10) Patent No.: US 6,761,269 B2
(45) Date of Patent: Jul. 13, 2004

(54) DISPENSING CONTAINER AND METHOD FOR MANUFACTURING SAME

(75) Inventor: Thomas E. Hamming, Racine, WI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 14 days.

(21) Appl. No.: 10/172,638

(22) Filed: Jun. 14, 2002

(65) Prior Publication Data

US 2003/0230504 A1 Dec. 18, 2003

(51) Int. Cl.[7] ..... B65D 25/54
(52) U.S. Cl. ..... 206/777
(58) Field of Search ..... 206/45.28, 45.29, 206/769, 770, 772, 773, 775, 776, 777; 221/63; 229/162

(56) References Cited

U.S. PATENT DOCUMENTS

| | | | |
|---|---|---|---|
| 1,076,635 | A | 10/1913 | Howard |
| 1,082,964 | A | 12/1913 | Macdonald |
| 1,691,995 | A | 11/1928 | Saulter |
| 1,907,922 | A | 5/1933 | Willis |
| 1,970,636 | A | 8/1934 | Tanner |
| 2,330,117 | A | 9/1943 | Feinberg et al. |
| 2,458,844 | A | 1/1949 | Foote |
| 2,472,521 | A | 6/1949 | Danenbauer |
| 2,507,403 | A | 5/1950 | Gluck |
| 2,624,521 | A | 1/1953 | Broeren |
| 2,743,009 | A | 4/1956 | Williamson et al. |
| 2,748,931 | A | 6/1956 | Taylor |
| 2,799,393 | A | 7/1957 | Klein |
| 2,803,339 | A | 8/1957 | Kuchenbecker |
| 2,853,185 | A | 9/1958 | Rollie |
| 2,864,493 | A | 12/1958 | Holcombe |
| 3,004,697 | A | 10/1961 | Stone |
| 3,021,002 | A * | 2/1962 | Guyer ..... 206/494 |
| 3,121,542 | A | 2/1964 | VanDyke et al. |
| 3,128,025 | A | 4/1964 | Buttery et al. |
| 3,144,191 | A | 8/1964 | Saidel |
| 3,159,323 | A | 12/1964 | Hawk |
| 3,166,187 | A | 1/1965 | Araujo |
| 3,228,519 | A | 1/1966 | Dong et al. |
| 3,246,742 | A | 4/1966 | Coe |
| 3,254,793 | A | 6/1966 | Palmer |
| 3,262,620 | A | 7/1966 | Burt et al. |
| 3,286,879 | A | 11/1966 | Philippon |
| 3,458,109 | A | 7/1969 | Compton et al. |
| 3,477,624 | A | 11/1969 | Branyon et al. |
| 3,530,980 | A | 9/1970 | Link |
| 3,587,840 | A | 6/1971 | Hultberg |
| 3,613,973 | A | 10/1971 | Jaeschke |
| 3,685,644 | A | 8/1972 | Cothran et al. |
| 3,698,548 | A | 10/1972 | Stenzel et al. |
| D232,081 | S | 7/1974 | Zine, Jr. |
| 4,062,447 | A | 12/1977 | Gardner |
| 4,151,914 | A | 5/1979 | Blatt |

(List continued on next page.)

FOREIGN PATENT DOCUMENTS

| | | |
|---|---|---|
| SE | 38587 | 3/1915 |
| WO | WO 00/15729 | 3/2000 |

*Primary Examiner*—Shian T. Luong

(57) ABSTRACT

A container for dispensing individual plastic wrap covers and a method of assembling such a container are disclosed. The container may be generally parallelopiped in shape and may include a hinged lid initially secured to the container along a score line. The lid may be torn along the score line and pivoted at the hinge to allow the user to access a smaller opening provided within the container. The smaller opening may be provided within a fifth flap provided integrally with the remainder of the template used to form the container. The opening may be sufficiently large to allow for the plastic wrap covers to be removed, but may be sufficiently small so as to prevent or substantially limit the removal of more than one plastic wrap cover at a time.

11 Claims, 5 Drawing Sheets

U.S. PATENT DOCUMENTS

| | | | | |
|---|---|---|---|---|
| 4,238,065 | A | | 12/1980 | Ragsdale |
| 4,298,123 | A | | 11/1981 | Roccaforte |
| D267,544 | S | | 1/1983 | Neto et al. |
| 4,373,687 | A | | 2/1983 | Zicko |
| 4,512,476 | A | | 4/1985 | Herrington |
| 4,667,824 | A | | 5/1987 | Ditchfield |
| 4,715,519 | A | | 12/1987 | Fischer |
| 4,790,436 | A | | 12/1988 | Nakamura |
| 4,813,539 | A | | 3/1989 | Church et al. |
| 4,925,028 | A | | 5/1990 | Smith |
| D313,752 | S | | 1/1991 | Dyble |
| 4,997,105 | A | | 3/1991 | Fischer |
| 4,998,656 | A | | 3/1991 | Hurh |
| D325,311 | S | | 4/1992 | Mygind |
| 5,121,839 | A | | 6/1992 | Lapp |
| 5,141,108 | A | | 8/1992 | Roccaforte |
| 5,449,070 | A | | 9/1995 | Broderick |
| 5,484,082 | A | | 1/1996 | Casper et al. |
| 5,511,663 | A | | 4/1996 | Shimura et al. |
| D372,387 | S | | 8/1996 | Kuchenbecker |
| 5,556,026 | A | * | 9/1996 | Blankitny ..... 229/123.1 |
| 5,577,612 | A | | 11/1996 | Chesson et al. |
| D383,934 | S | | 9/1997 | McNaughton |
| 5,662,758 | A | | 9/1997 | Hamilton et al. |
| D395,823 | S | | 7/1998 | Durand |
| D402,554 | S | * | 12/1998 | Barchelor ..... D9/433 |
| 5,871,607 | A | | 2/1999 | Hamilton et al. |
| D414,061 | S | | 9/1999 | Peachey |
| 5,971,150 | A | | 10/1999 | Anderson et al. |
| 5,996,797 | A | | 12/1999 | Flaig |
| D465,416 | S | * | 11/2002 | Dzwill et al. ..... D9/414 |
| 6,474,539 | B1 | * | 11/2002 | Van Der Horst ..... 229/120.14 |
| 6,499,626 | B1 | * | 12/2002 | Julius ..... 221/63 |
| 6,523,694 | B2 | * | 2/2003 | Lux, Jr. et al. ..... 206/782 |
| 6,554,156 | B1 | * | 4/2003 | Chong ..... 221/63 |
| 6,592,004 | B2 | * | 7/2003 | Huang et al. ..... 221/63 |

* cited by examiner

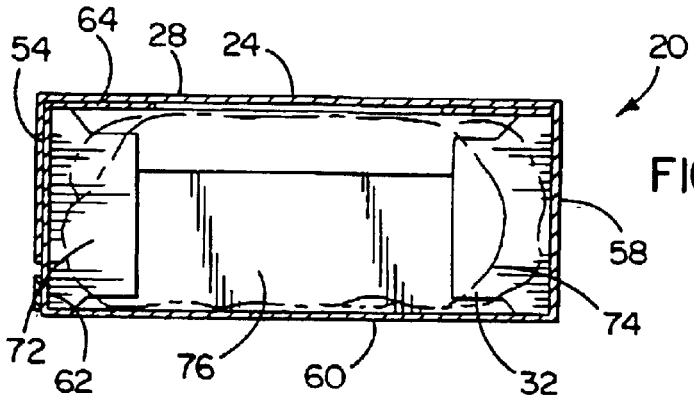
FIG. 4
FIG. 5
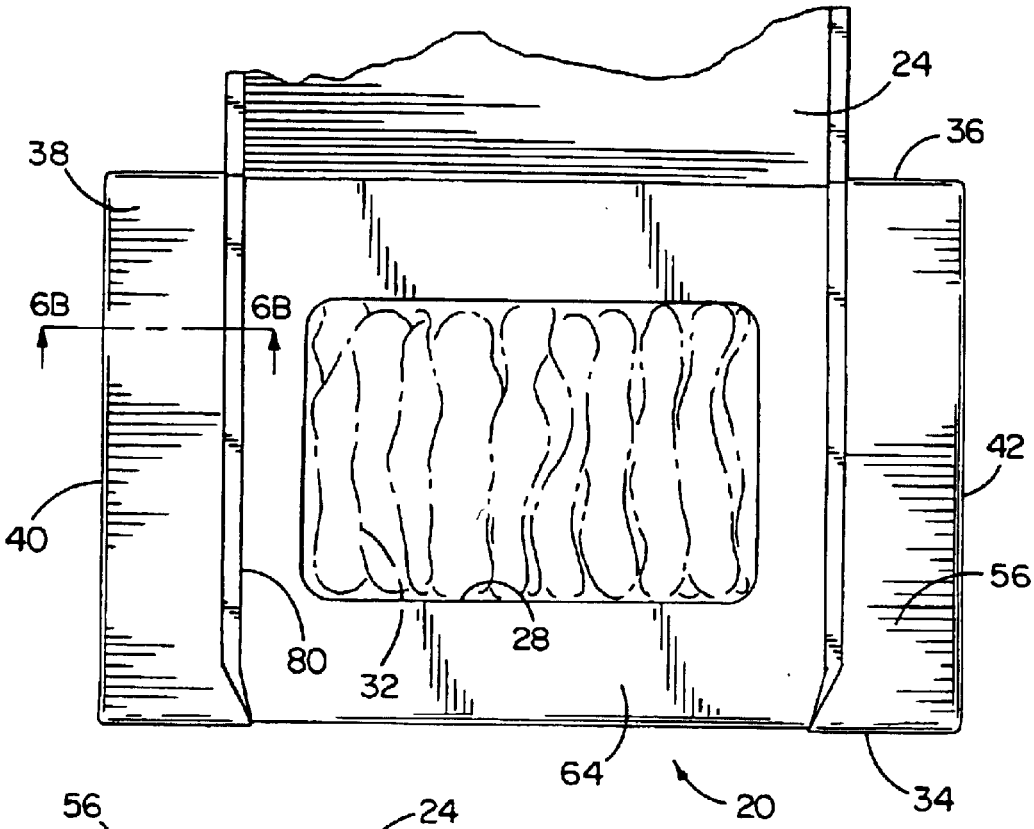
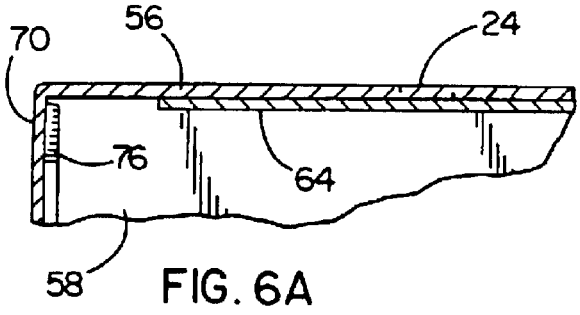
FIG. 6A
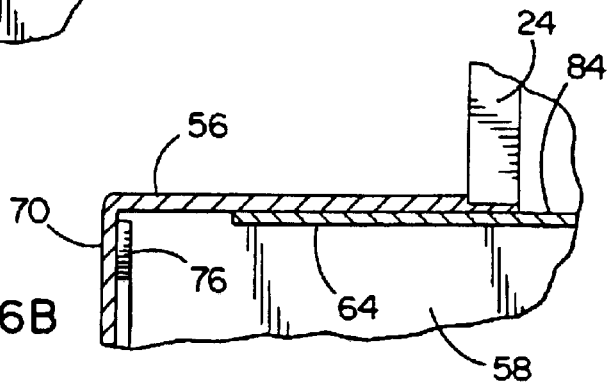
FIG. 6B

DISPENSING CONTAINER AND METHOD FOR MANUFACTURING SAME

The disclosure generally relates to dispensers and, more particularly, relates to dispensers for use in conjunction with plastic food covers and the like.

BACKGROUND

Containers for the storage and dispersal of wound films such as plastic wrap, aluminum foil, wax paper and the like are well known. Such wound films are commonly used for covering and protecting food products. Similarly, it is known to cover and protect a food product with pre-formed plastic wrap covers. Such covers are manufactured individually, rather than as a wound film, and are often marketed and sold in stacks in dispensing containers. The plastic wrap cover may be quicker and easier to use than the wound films in that they are of a pre-formed size and typically include an elastic band about a perimeter to allow for quick, snug fitting to a bowl or the like.

Conventionally, such plastic wrap covers are sold in a tub-style dispensing container having a lidded opening permitting cover withdrawal. The relatively large opening of the dispenser allows for easy access to the covers, but may be so large that it may be difficult to remove a single cover at a time. Thus, a user often grabs more covers than needed, resulting in the user throwing away the extra, unwanted covers that have been accidentally removed from the container. The elastic properties of the wraps and compressed loading of the wraps into the container often augment such unwanted dispersal. Further, the opening of the dispensing container is often so large that it exposes many of the covers to environmental contaminants. This contamination also results in several bags being wasted or undesirably soiled.

When manufacturing such dispensing containers, it can therefore be seen that many criteria must be examined to suit the needs of a user and reduce undesirable waste. In particular, the dispensing container should be a shape that is easily stored. Additionally, the dispensing opening of the container should be designed so that the user can easily remove a single cover at a time. Further, the opening should be designed so that the opening reduces unwanted contamination of the covers. The lid of the dispensing container should also be relatively easy to open and re-close to ensure protection of the covers between uses.

A need therefore exists for an improved dispensing container which restricts the dispensing of multiple plastic wrap covers at a single use and sufficiently protects the covers from undesirable exposure between use of the covers.

SUMMARY OF THE DISCLOSURE

In accordance with one aspect of the disclosure, a dispensing carton is provided which may include a front panel, a back panel, a top panel, a bottom panel, at least one end panel, and a dispensing panel. The back panel is substantially parallel to the front panel. The top panel extends between the front panel and the back panel and includes a hinged lid movable between open and closed positions. The bottom panel extends between the front panel and the back panel and is substantially parallel to the top panel. At least one end panel extends across first and second ends of the container. The dispensing panel is positioned adjacent and substantially parallel to the top panel and includes a dispensing aperture. The dispensing aperture is exposed when the lid is in the open position and is covered when the lid is in the closed position.

In accordance with another aspect of the disclosure, a method of forming a dispensing carton is disclosed which may include providing a template having adjacent front, top, back, bottom, latch, and dispensing panels, folding the front, top, back, bottom, latch, and dispensing panels into a tubular configuration, loading compressed articles into the dispensing carton, and folding end flaps to close first and second ends of the carton. The dispensing flap may have a dispensing aperture and be secured to an inside surface of the top panel. The compressed articles may be loaded into the dispensing carton through one of the open ends of the carton.

In accordance with another aspect of the disclosure, a dispensing carton in provided which may include a parallelopidedly shaped box and a lid. The box may include an aperture formed in at least one side. The lid may be hinged to the box and be adapted to move to a first position covering the aperture to a second position exposing the aperture. The lid and the side in which the aperture is disposed may be formed from first and second layers.

These and other aspects and features of the disclosure will become more apparent upon reading the following detailed description when taken in conjunction with the accompanying drawings.

BRIEF DESCRIPTION OF THE DRAWINGS

FIG. 4 is a longitudinal sectional view of the container of FIG. 1 taken along line 4—4 of FIG. 1;

FIG. 5 is a top view of a dispensing container constructed in accordance with the teachings of the disclosure and depicted in an assembled, open configuration;

FIG. 6A is a fragmentary sectional view taken along line 6A—6A of FIG. 1;

FIG. 6B is a fragmentary sectional view taken along line 6B—6B of FIG. 1;

Figure 1:
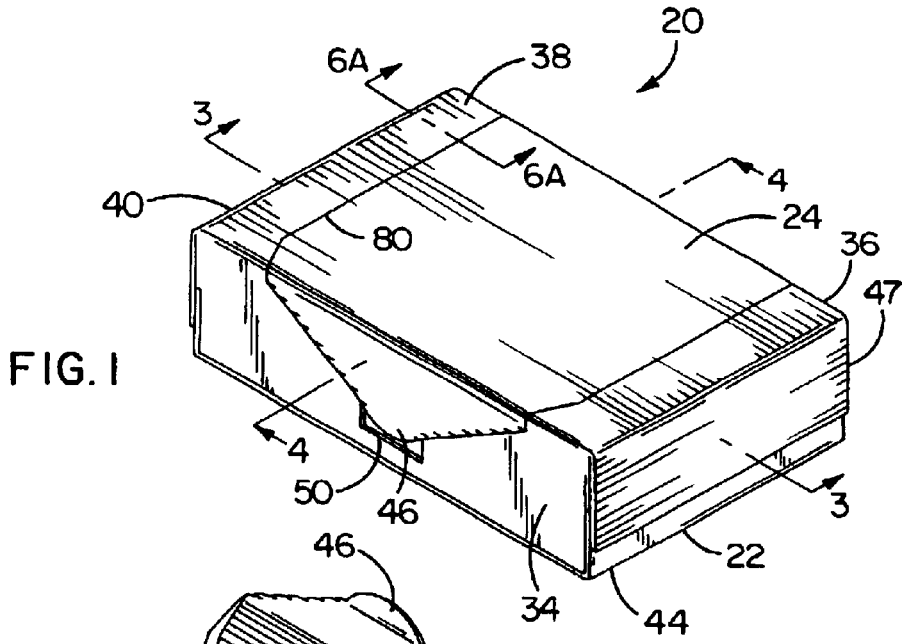
FIG. 1 is an isometric view of a dispensing container constructed in accordance with the teachings of the disclosure and depicted in an assembled, closed configuration.

While the disclosure is susceptible to various modifications and alternative constructions, certain illustrative embodiments thereof have been shown in the drawings and will be described below in detail. It should be understood, however, that there is no intention to limit the disclosure to the specific forms disclosed, but on the contrary, the intention is to cover all modifications, alternative constructions and equivalents falling within the spirit and scope of the disclosure as defined by the appended claims.

DETAILED DESCRIPTION OF THE DISCLOSURE

Referring now to the drawings, and with specific reference to FIG. 1, a dispensing container constructed in accordance with the teachings of the disclosure is generally depicted by reference numeral 20. In a preferred embodiment, the dispensing container is manufactured from an unitary piece of material such as paperboard, cardboard, corrugated board, microfluted board, or the like, and is folded and joined in a series of consecutive steps as will be described in further detail herein to form the dispensing container. However, it is to be understood that the container 20 could be manufactured from multiple pieces as well.

Figure 2:
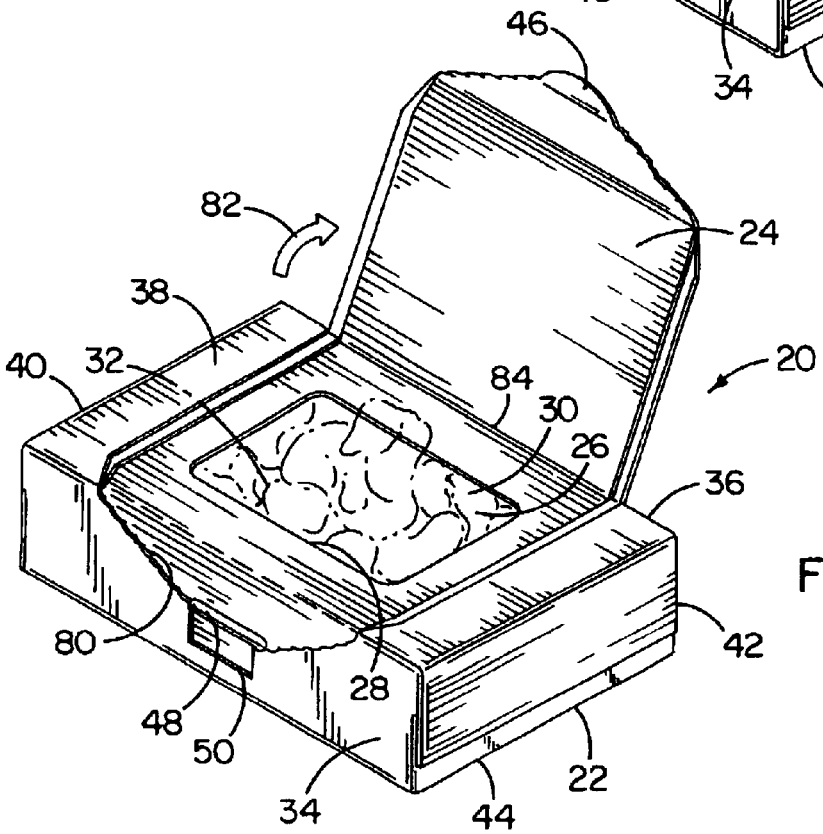
FIG. 2 is an isometric view of a dispensing container constructed in accordance with the teachings of the disclosure and depicted in an assembled, open configuration.

With reference now to FIGS. 1 and 2, the container 20 is shown to include closed and open configurations, respectively. More specifically, the container 20 includes a base 22 to which a lid 24 is hinged for allowing or preventing access to a storage space 26. Access to the storage space 26 can be had through a dispensing opening 28 to thereby allow for stored elements 30 to be withdrawn by a user. In the depicted embodiment, the stored elements 30 are provided in the form of individual cover wraps 32 which one of ordinary skill in the art will readily understand to be preformed plastic sheets having an elastic band about their peripheries to facilitate attachment to bowls and the like. However, it is to be understood that the teachings of the disclosure can be used for constructing numerous other types of stored elements 30 wherein it is desirable to dispense one such item at a time.

The container 20 may include a front 34, a back 36, a top 38, first and second sides 40 and 42, and a bottom 44. As can be seen best from FIG. 2, the top 38 and front 34 may be formed from multiple layers as will be described in further detail herein. Moreover, the lid 24 may be formed with a closing tab 46, while the front 34 may be formed with a slot 48, as well as a finger recess 50, to allow for ready reclosing of the lid 24.

Figure 7:
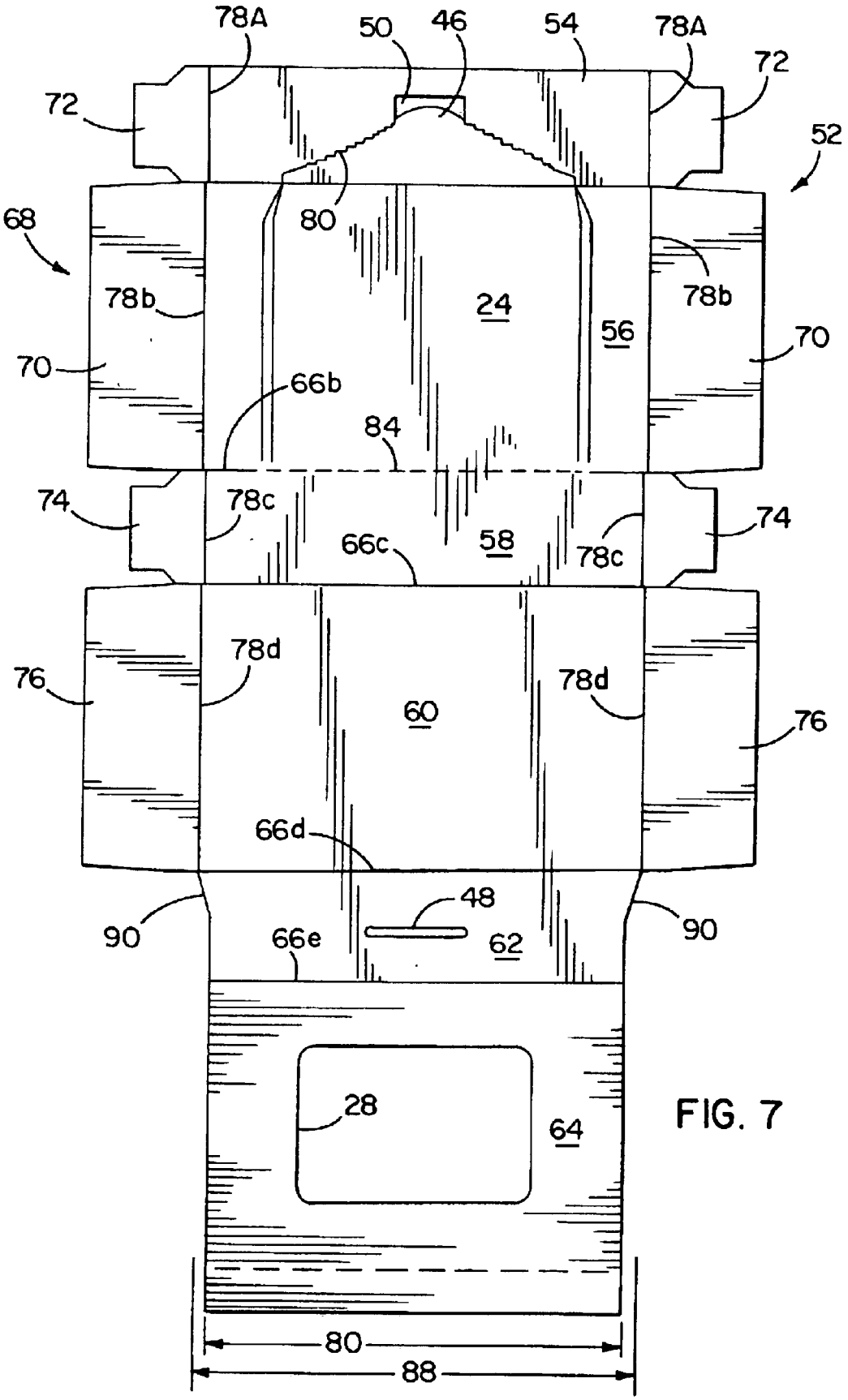
FIG. 7 is a plan view of a template which may be used to construct the dispensing container of FIG. 1.

The container 20 may be formed from a template 52 as shown best in FIG. 7. As shown therein, the template 52 includes a plurality of flaps or panels integrally connected and, as indicated above, possibly formed from a unitary piece of paperboard. The template 52 may include a front flap 54, a top flap 56, a back flap 58, a bottom flap 60, a latch flap 62, and a dispensing or fifth flap 64 arranged in adjacent fashion and separated by folds 66*a–e* respectively. In addition, the template 52 may include a plurality of end flaps 68 for forming the first and second ends 40, 42. The end flaps 68 may include a pair of top major flaps 70, a pair of front minor flaps 72, a pair of back minor flaps 74, and a pair of bottom major flaps 76. Such end flaps 68 may be separated from the top flap 56, front flap 54, back flap 58, and bottom flap 60 by plurality of folds 78*a–d*. When folded, in a manner described in further detail herein, it will be seen that the template 52 can form the container 20 with a front 34 and top 38 which include at least first and second plies. In so doing, when the lid 24 is opened as shown in FIG. 2, the storage space 26 is not completely exposed, but is still partially protected by the latch flap 62 and dispensing flap 64 with only the relatively small dispensing opening 28 allowing for access to the stored elements 30. The dispensing opening 28 may have a substantially smaller cross-sectional area than the lid 24. In order to allow for the lid 24 to so move, it will be seen, as shown best in FIG. 1, that the top flap 56 and front flap 54 are both provided with a scoreline 80 extending from fold 66*a*. Such a scoreline 80 provides a line of weakness whereby when a user grasps the tab 46, and pulls the lid 24 indicated by the arrow 82, the lid 24 tears away from the remainder of the carton 20 in an orderly fashion. Moreover, in the depicted embodiment, as shown best in FIG. 7, the fold 66*b* is partially perforated along tearline 84. Such structure allows for the lid 24 to be completely and easily removed from the container 20, in the event that the user does not wish to reclose the container but does wish to allow for complete and easy access at all times to the dispensing opening 28.

As shown best in FIG. 7 and FIGS. 6A and 6B, the dispensing flap 64 may be of a lesser width 86 than the width of the bottom flap 66 as indicated by reference numeral 88. In addition, the dispensing flap 64 may include canted sides 90 which enable the template 52 to taper from the width 88 to the width 86. As shown in FIGS. 6A and 6B, the dispenser flap 64 therefore does not extend all the way to the first and second ends 40, 42.

Figure 8:
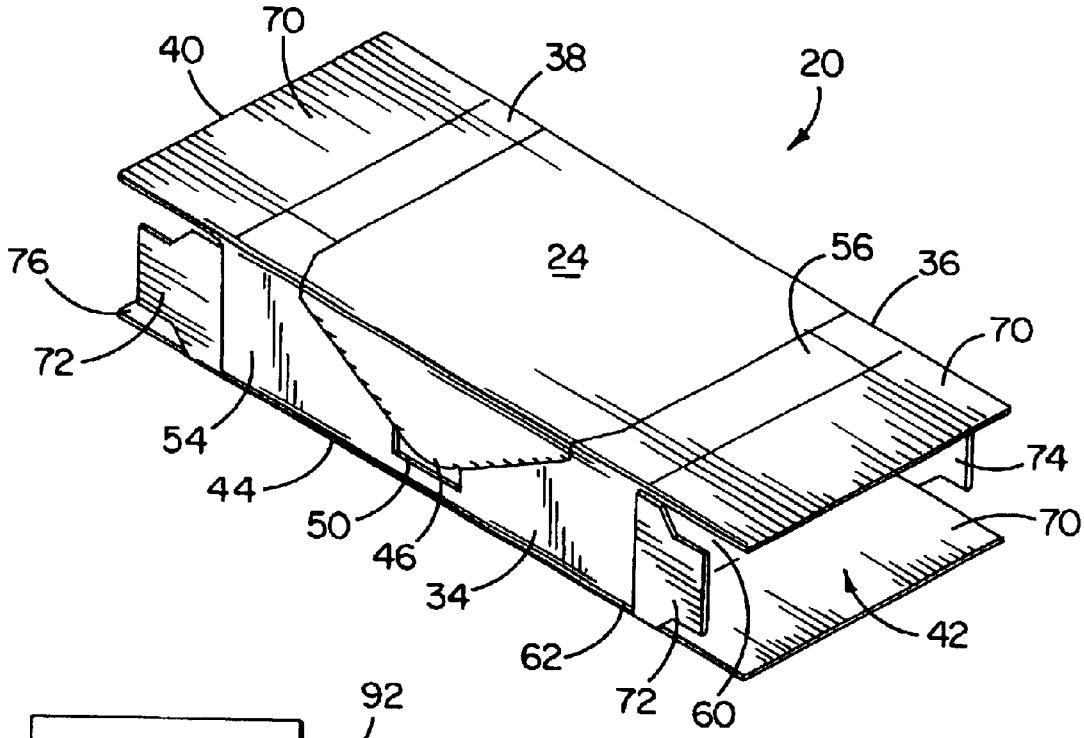
FIG. 8 is an isometric view of the dispensing container of FIG. 1 depicted in a partially assembled state.
Figure 9:
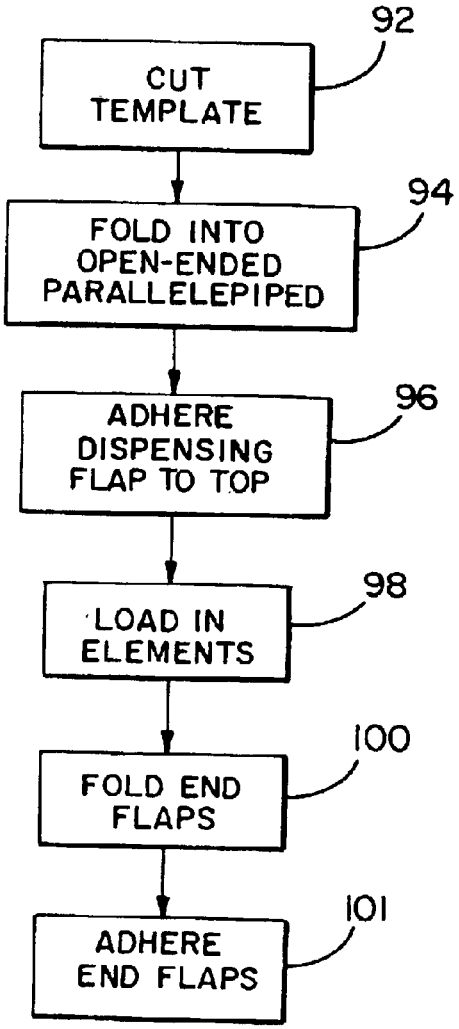
FIG. 9 is a flow chart depicting a sample sequence of the steps which may be taken for constructing a dispensing container in accordance with the teachings of the disclosure.

In constructing the container 20, in accordance with the teachings of the disclosure, the container 20 can be formed in accordance with the steps depicted in the flowchart of FIG. 9. As indicated therein, a first step 92 may be to cut the template 52 from a sheet stock of paperboard material or the like. Once the template 52 is so formed, it can be folded in a series of 90° angles, at each of the folds 66*a–e*, into the open-ended parallelopiped shape of FIG. 8. This step is depicted by reference numeral 94 in FIG. 9. In order to secure the template 52 into such a shape, the dispensing flap 64 may be adhered using suitable adhesives to the inside surface of the top flap 56 as shown best in FIG. 4. In the alternative, or in addition to, the latch flap 62 can be similarly adhered to the front flap 54 as also shown in FIG. 4. Such a step is depicted by reference numeral 96 in FIG. 9.

Figure 3:
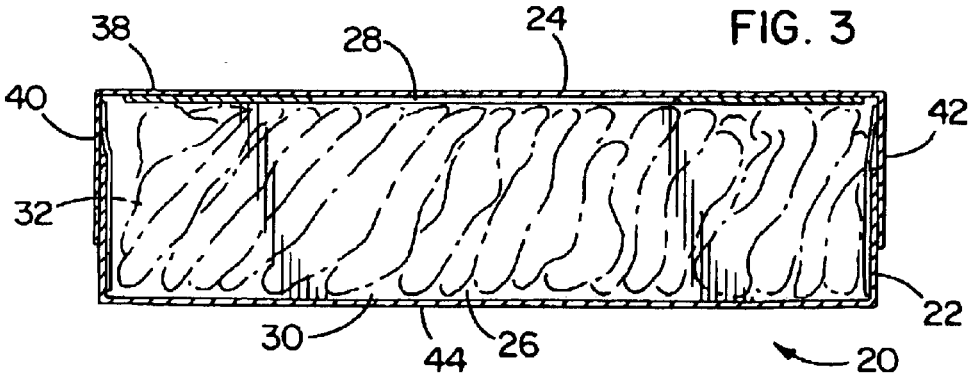
FIG. 3 is a lateral sectional view of the container of FIG. 1 taken along line 3—3 of FIG. 1.

Once the structure as shown in FIG. 8 is so formed, the stored elements 30 can be loaded into one of the first and second open ends 40, 42. In the event that the stored elements are the cover 32 referenced above, which include elastic bands, the stored elements 30 can be loaded into the storage space 26 relatively tightly and under compression. It may, therefore, be advantageous to close one of the first and second ends 40, 42 prior to loading the stored elements 30 into the storage space 26. This step is depicted by reference numeral 98 in FIG. 9. Once the stored elements 30 are loaded into the storage space 26, the first and second ends 40, 42 (or the remaining of the first and second ends 40, 42) are closed. As indicated by step 100, this may be accomplished first by folding the minor end flaps 72, 74 inwardly at 90° angles as shown in FIG. 4, then folding the bottom major flaps 76 upwardly at 90° angles, and the top major flaps 70 downwardly at 90° angles as shown best in FIG. 3. Adhesive can be used at each of the folds to secure the end flaps 78 into place.

Figure 10:
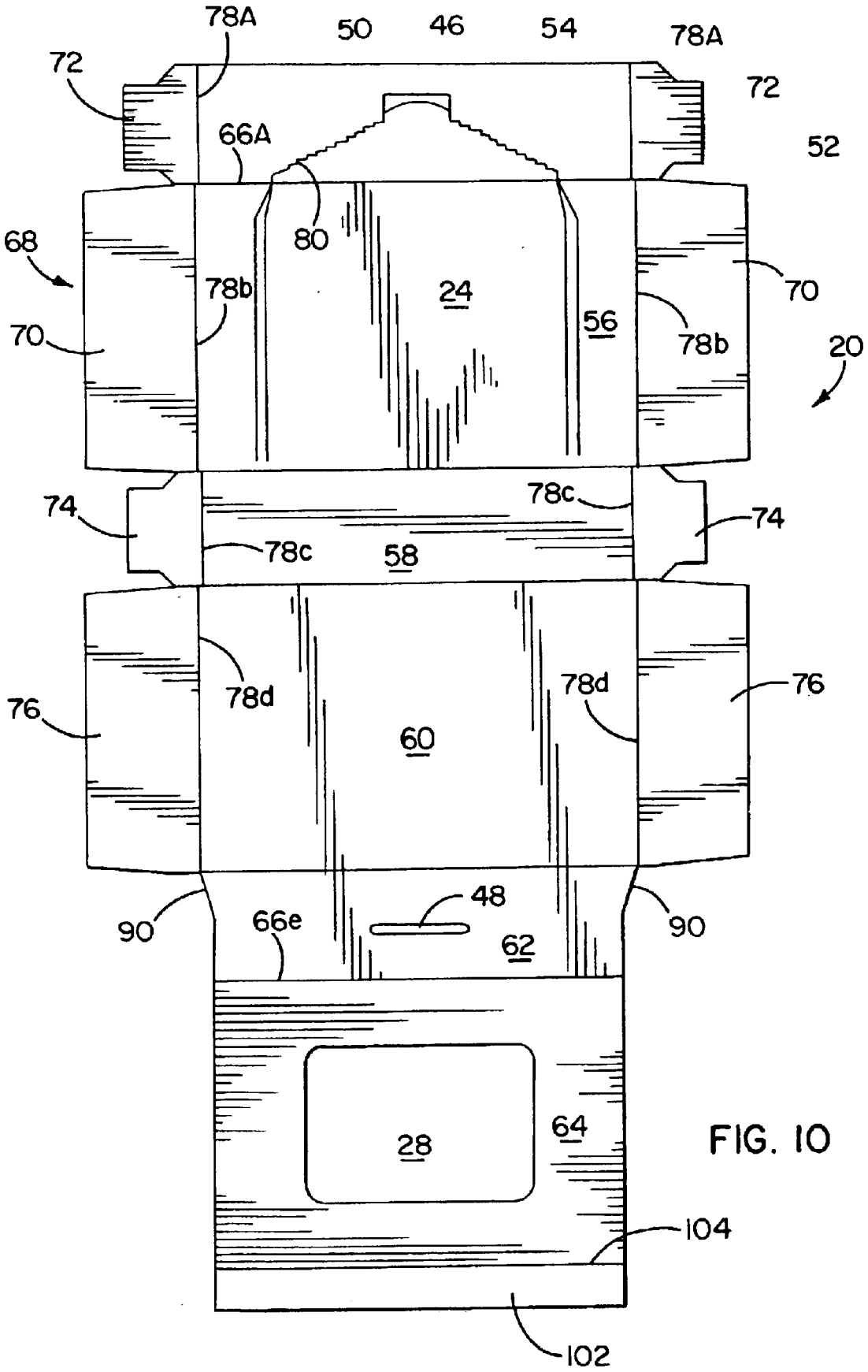
FIG. 10 is a plan view of a second embodiment of a template which may be used to construct a dispensing container in accordance with the teachings of the disclosure.

A further alternative embodiment of a container constructed in accordance with the teachings of the disclosure is generally referred to again by reference numeral 20 in FIG. 10. Accordingly, wherein like elements are used, like reference numerals are employed as well. One difference between the template depicted in FIG. 10 from that depicted in FIG. 7, is the further inclusion of a reinforcement flap 102 extending from the dispenser flap 64 at a fold 104. If it is desired to secure the dispensing flap 64 not just to the dispensing flap 64, but also to provide a more structurally rigid container 20, the reinforcing flap 102 can be folded and adhered to the back flap 58. In yet further embodiments, it is to be understood, that still further reinforcements struts, flaps, or the like could be provided.

From the foregoing, one of ordinary skill in the art will understand that the teachings of the disclosure can be used to construct a dispensing container having a hinged and reclosable lid adapted to close and allow access to a storage space by way of a relatively small dispensing aperture provided within a fifth flap of the container.

What is claimed is:

1. A dispensing carton, comprising:

a front panel;

a back panel substantially parallel to the front panel;

a top panel extending between the front panel and the back panel, the top panel including a dispensing aperture and a hinged lid movable between open and closed positions relative to the top panel dispensing aperture;

a bottom panel extending between the front panel and the back panel, the bottom panel being substantially parallel to the top panel;

at least one end panel extending across first and second ends of the container; and a dispensing panel positioned adjacent and substantially parallel to the top panel, the dispensing panel including a dispensing aperture, the dispensing aperture being exposed when the lid is in the open position and covered when the lid is in the closed position, the dispensing panel being separate from, and unattached to, the top panel.

2. The dispensing carton of claim 1, wherein the front, back, top, bottom, end, and dispensing panels are integrally formed.

3. The dispensing carton of claim 1, further including a second front panel, the second front panel being adjacent and substantially parallel to the front panel, the second front panel extending between the bottom panel and the dispensing panel.

4. The dispensing carton of claim 1, wherein the lid is hinged a fold between the top panel and the back panel, the fold being perforated.

5. The dispensing carton of claim 1, wherein the lid is connected to the top panel along a scored line.

6. The dispensing carton of claim 1, further including a plurality of compressible articles stored within the carton, the aperture having a cross-sectional area smaller than a cross-sectional area of the compressed article.

7. The dispensing carton of claim 6, wherein the compressed articles are plastic wrap covers.

8. The dispensing carton of claim 1, wherein the lid is formed from portions of the top panel and the front panel.

9. The dispensing carton of claim 8, wherein the lid includes a tab and the front panel includes a slot adapted to receive the tab.

10. The dispensing carton of claim 5, wherein the scored line extends only partially through the top panel.

11. The dispensing carton of claim 1, further including a reinforcement flap extending from the dispensing panel and secured to the back panel.

* * * * *